US011220830B2

(12) United States Patent
Green

(10) Patent No.: US 11,220,830 B2
(45) Date of Patent: Jan. 11, 2022

(54) STRENGTHENING ASSEMBLIES

(71) Applicant: TECTONIC FACADES LTD, Newcastle-Under-Lyme (GB)

(72) Inventor: Adam Green, Newcastle-Under-Lyme (GB)

(73) Assignee: TECTONIC FACADES LTD, Newcastle-Under-Lyme (GB)

( * ) Notice: Subject to any disclaimer, the term of this patent is extended or adjusted under 35 U.S.C. 154(b) by 0 days.

(21) Appl. No.: 17/048,818

(22) PCT Filed: Apr. 18, 2019

(86) PCT No.: PCT/GB2019/051115

§ 371 (c)(1),
(2) Date: Oct. 19, 2020

(87) PCT Pub. No.: WO2019/202335

PCT Pub. Date: Oct. 24, 2019

(65) Prior Publication Data

US 2021/0123252 A1 Apr. 29, 2021

(30) Foreign Application Priority Data

Apr. 19, 2018 (GB) ..... 1806379

(51) Int. Cl.
*E04G 23/02* (2006.01)
*E04C 3/34* (2006.01)

(52) U.S. Cl.
CPC ..... *E04G 23/0218* (2013.01); *E04C 3/34* (2013.01)

(58) Field of Classification Search
CPC ..... E04G 2023/0251; E04G 23/0218; E04G 23/0225; E04C 3/34; E02D 5/60
See application file for complete search history.

(56) References Cited

U.S. PATENT DOCUMENTS

| | | | | |
|---|---|---|---|---|
| 6,006,488 | A * | 12/1999 | Okitomo | E02D 5/60 52/834 |
| 6,167,672 | B1 * | 1/2001 | Okitomo | E02D 5/60 405/216 |
| 9,856,647 | B1 * | 1/2018 | Kim | E04B 1/943 |
| 2016/0060892 | A1 | 3/2016 | Odegard et al. | |
| 2021/0123252 | A1 * | 4/2021 | Green | E04G 23/0218 |

FOREIGN PATENT DOCUMENTS

| | | | |
|---|---|---|---|
| CA | 2497860 | A1 | 8/2006 |
| CN | 206928692 | U | 1/2016 |
| JP | H 10-273976 | A | 10/1998 |
| JP | 2012-246627 | A | 12/2012 |

OTHER PUBLICATIONS

International Search Report and Written Opinion for Application No. PCT/GB2019/051115 dated Jun. 14, 2019.

* cited by examiner

*Primary Examiner* — Andrew J Triggs
(74) *Attorney, Agent, or Firm* — Alston & Bird LLP

(57) ABSTRACT

An assembly (10) for strengthening a building column. The assembly comprising two pairs of elongate members (16, 28) beatable around the building column and with inter engaging engagement formations (22, 24, 32) and (34) which once inter engaged prevent the elongate members (16, 28) from being separated in either a directly longitudinal or a directly transverse direction.

20 Claims, 12 Drawing Sheets

STRENGTHENING ASSEMBLIES

CROSS-REFERENCE TO RELATED APPLICATIONS

This application is a national phase entry of International Application No. PCT/GB2019/051115, filed Apr. 18, 2019, which claims priority to Great Britain Patent Application No. 1806379.2, filed on Apr. 19, 2018, the entire contents of both of which are incorporated herein by reference.

This invention concerns a strengthening assembly, and particularly for a building column, and also a method of strengthening a building column.

Building columns such as for instance used in concrete buildings such as car parks or other types, may at times require strengthening. Conventionally strengthening would be provided by wrapping the columns but this involves a not insignificant amount of time and labour in applying the wrapping. This leads to cost and also possession of the building for a significant time period.

According to a first aspect of the invention there is provided an assembly for strengthening a building column, the assembly comprising a plurality of rigid elongate parts which in use have their longitudinal directions parallel to the building column, the elongate parts including inter engaging engagement formations which permit the elongate members to connect together to surround the column.

The engagement formations may be such that once inter engaged the elongate parts cannot be separated in either a directly longitudinal or a directly transverse direction.

The engagement formations may be in the form of respective dovetail profile projections and recesses, and the projections and recesses may be inclined such that upper and lower edges of the projections are inclined downwardly inwards relative to a column in use.

The inclination to the vertical of the engagement formations may be at between 10 and 45°, and more particularly between 20 and 35°.

Two, three or four elongate members may be provided.

Four elongate members may be provided, with two first parts and two second parts.

The engagement formations may be such that when two first parts are located in required positions on opposite sides of a column, two second parts can be brought together at an inclination, and preferably a downwards inclination, to respectively interconnect the four parts.

The elongate member first parts may be U shaped in plan view.

Flanges may be provided on the second parts to cover the engagement formations on the elongate members once interconnected.

A collar may be locatable over upper ends of the elongate members. The collar may be formed of two parts, which can be slid into position on top of the upper ends of the elongate members, and the two parts may have a U shape in plan view.

The elongate members may be made of concrete, may be made of ultra high performance concrete (UHPC), and may be fibre reinforced (UHPFRC).

The collar may be made of concrete, may be made of ultra high performance concrete (UHPC) and may be fibre reinforced (UHPFRC).

According to a second aspect of the invention there is provided a method for strengthening a building column, the method comprising locating an assembly according to any of the preceding twelve paragraphs around the building column.

The elongate parts may be spaced a small distance away from the building column, and may be spaced at between 5 and 20 mm away from the building column.

Once the elongate parts are interconnected in position around the building column, the two parts of the collar may be slid on top of the elongate members from opposite sides until they meet.

The elongate member first parts may be located in a required position relative to the building column and the second parts then interconnected to the first parts.

An embodiment of the present invention will now be described by way of example only and with reference to the accompanying drawings, in which:—

Figure 1:
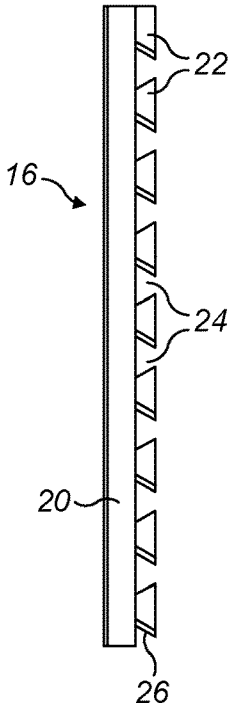
FIGS. 1, 2, 3 and 4 are respectively side, end, plan and perspective views of a first component according to the invention.
Figure 2:
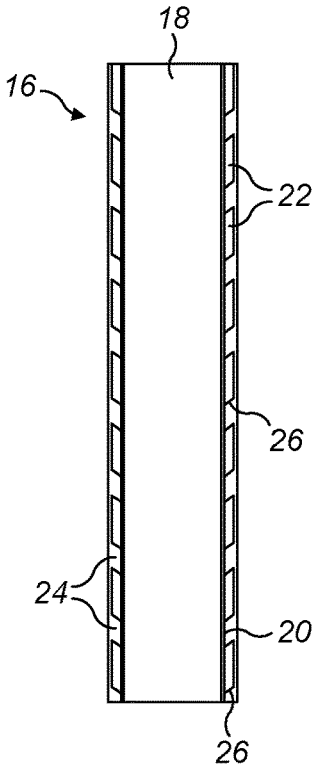
Figure 3:
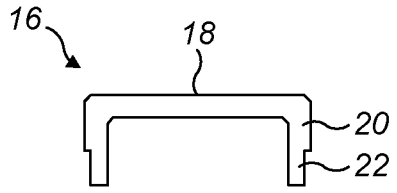
Figure 4:
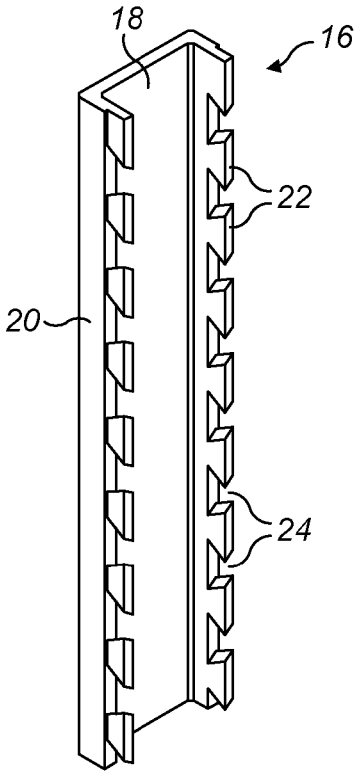

The drawings show an assembly 10 for strengthening a building column 12. Such a building column 12 is shown diagrammatically inter alia in FIG. 13 and is a rectangular column 12 extending between two building floors 14. Such an arrangement may be found for instance in a multi-story car park, or many other applications.

The assembly comprises a pair of first elongate members 16 made of UHPC and which may be fibre reinforced (UHPFRC). The first elongate members 16 have a shallow U shape in plan view with a base 18 and two short side walls 20. A plurality of dovetail shape projections 22 and corresponding dovetail shape recesses 24 located between each pair of projections 22, are provided on the ends of the side walls 20. The projections 22 and recesses 24 are inclined such that their upper and lower edges 26 are inclined inwardly downwardly i.e. towards the opposite side wall 20, and this inclination could typically be at around 30°. As can be seen the projections 22 are recessed slightly inwardly from the outside of the side walls 20.

Figure 5:
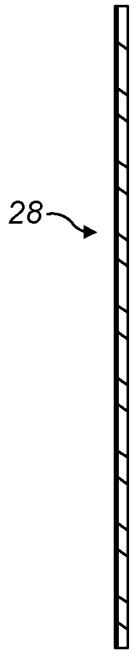
FIGS. 5, 6 and 7 are respectively side, end and plan views of a second component according to the invention.
Figure 6:
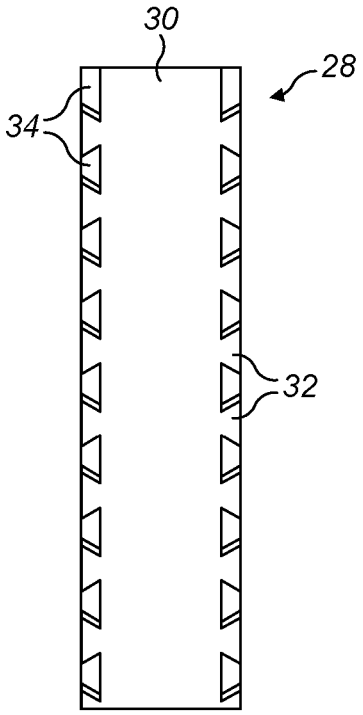
Figure 7:
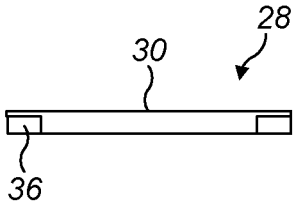
Figure 8:
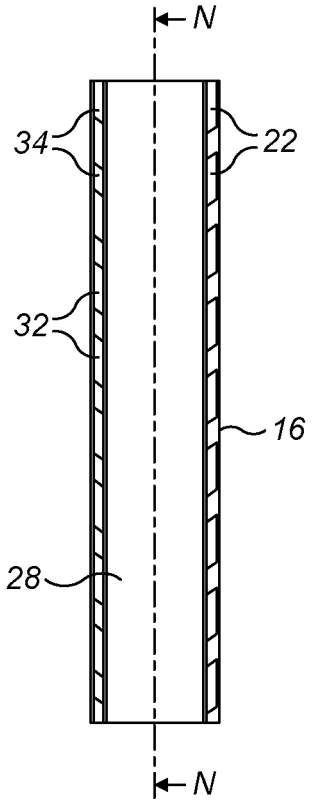
FIG. 8 is a side view of a first and second component connected together.
Figure 9:
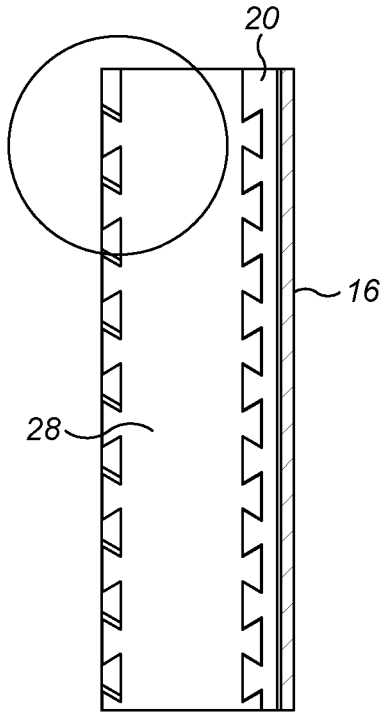
FIG. 9 is a sectional view along the line N-N of FIG. 8.
Figure 10:
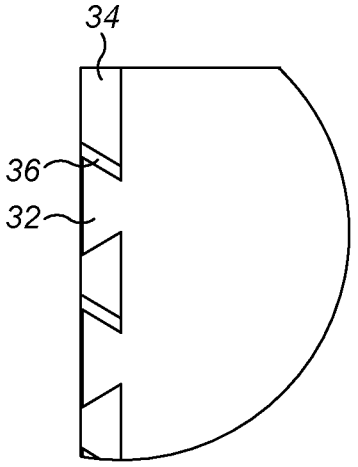
FIG. 10 is a detailed view of part of FIG. 9 as circled.
Figure 11:
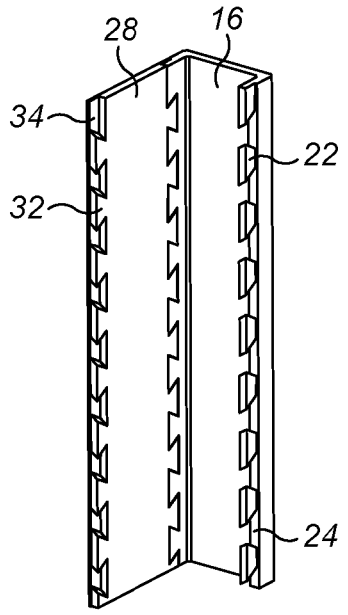
FIG. 11 is a perspective view of the first and second connected components.
Figure 12:
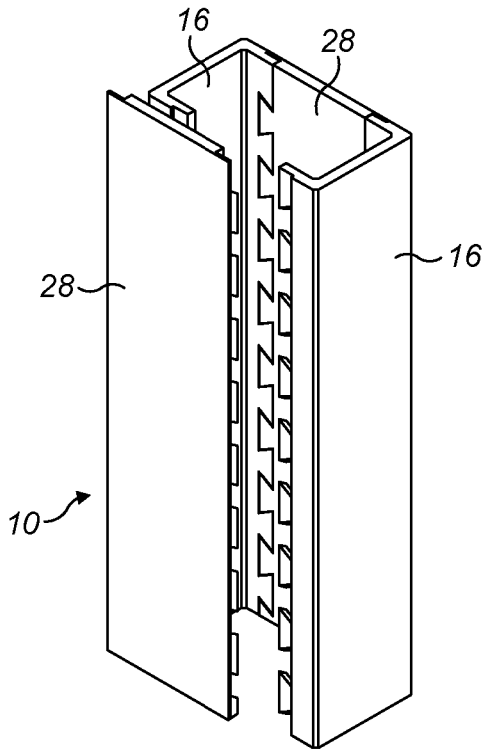
FIG. 12 is a perspective view showing a second component connected to two first components, with a further third component being introduced.

The assembly 10 also comprises a pair of second elongate members 28 as shown in FIGS. 5 to 7, made of similar material to the first elongate members 16. The second elongate members 28 are in the form of a central plate section 30 with alternate dovetail shape projections 32 and recesses 34 along the outside edge of the central plate section 30, with an outer flange 36 overlying the projections 32 and recesses 34. The projections 32 and recesses 34 correspond in shape and size to those on the first elongate members 16, except that they are in an alternative configuration, i.e. starting with a recess 34 at the top rather than a projection 32. Again, the projections 32 and recesses 34 are inclined with inclined edges 36, and this inclination could typically be at around 30°.

The first and second elongate members 16, 28 can be interconnected as shown for instance in FIGS. 8 to 11, with the second engagement members 28 being interconnected to the first elongate members 16 by bringing them downwardly and inwardly relative to the first elongate members 16.

The assembly 10 also comprises a rectangular top plate 40 with an open central section formed from two parts 42 with a U shape in plan view, as illustrated for instance in FIGS. 20 to 24. The top plate 40 can again be made of similar material to the elongate members 16, 28.

Figure 13:
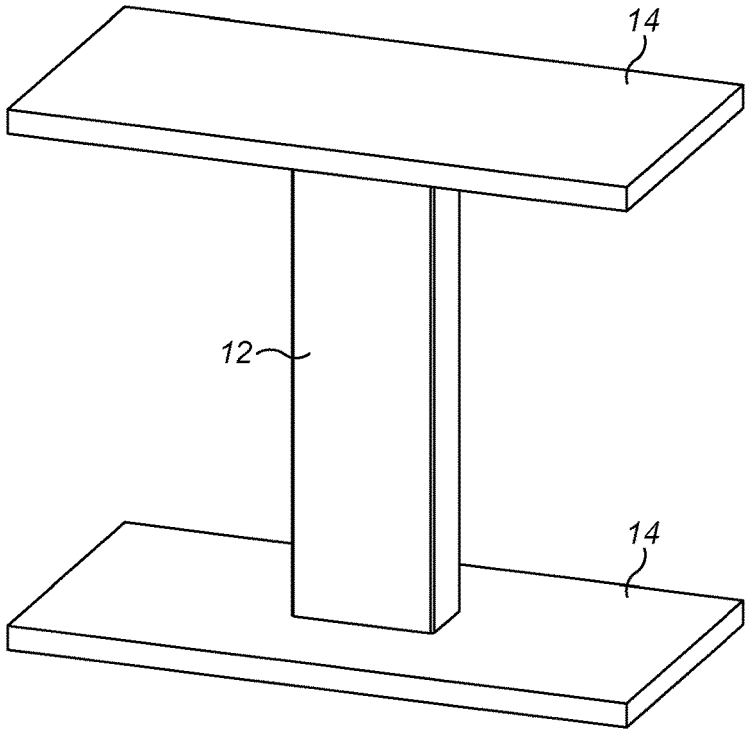
FIGS. 13 to 16 are diagrammatic sequential perspective views showing installation of an assembly according to the invention.
Figure 14:
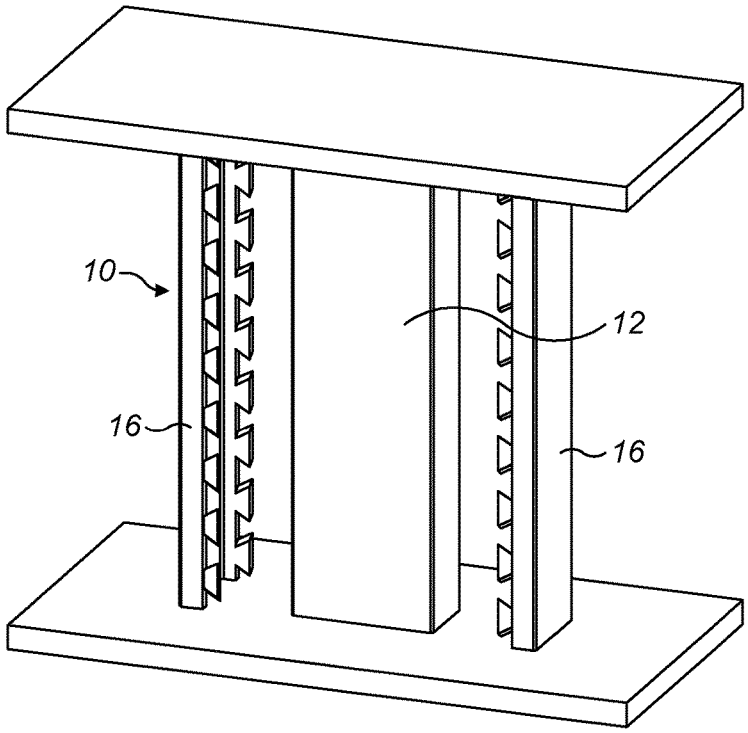
Figure 15:
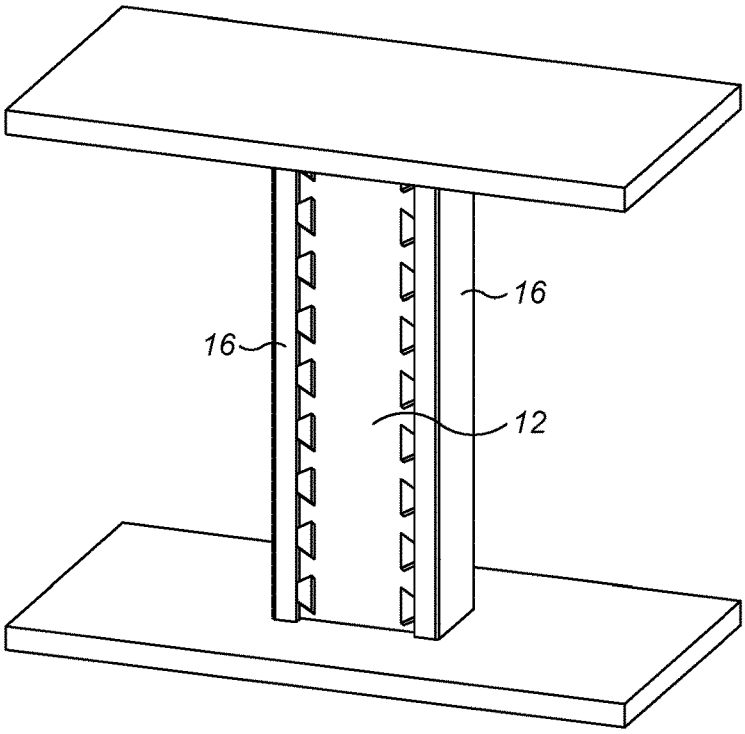
Figure 16:
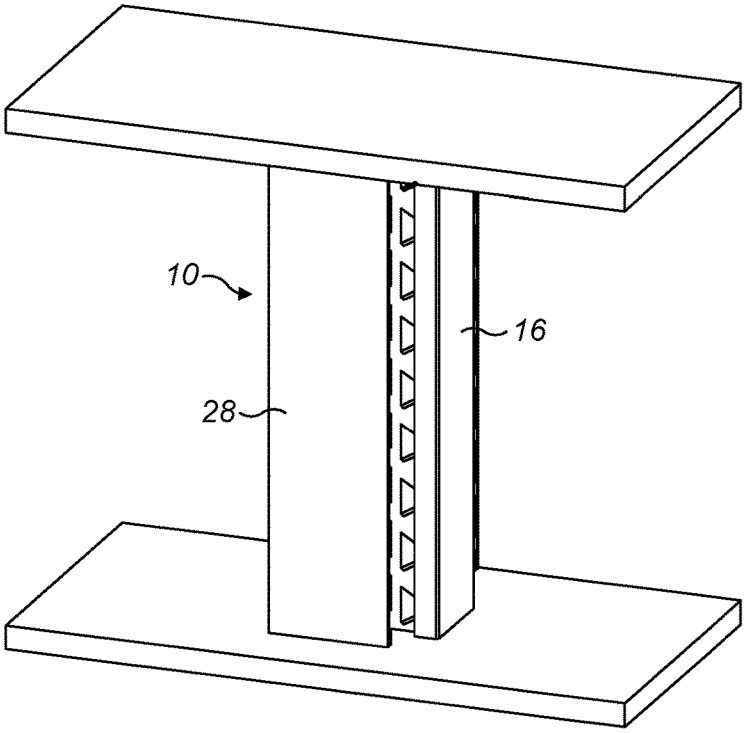

FIG. 13 onwards show the assembly 10 being mounted to strengthen the building column 12. As shown in FIG. 14 two first elongate members 16 are introduced between the floors 14 around opposite shorter edges of the building column 12, with the side walls 20 of respective first elongate members 16 facing each other. The first elongate members 16 are set in a required position, which typically could be at around 10 to 15 mm spaced outwardly from the column 12.

Figure 17:
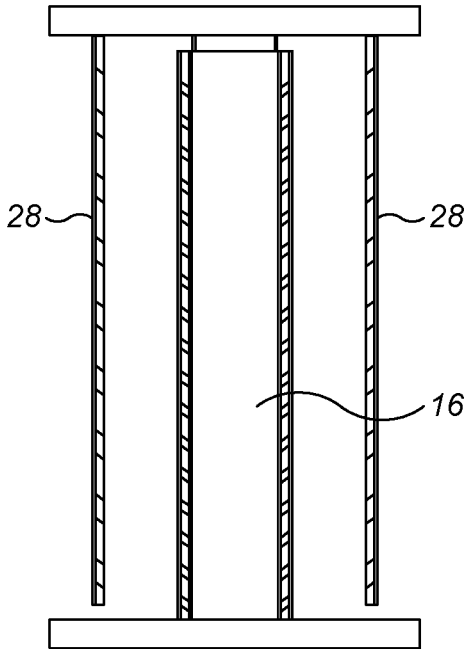
FIGS. 17 to 20 are diagrammatic sequential side views showing installation of an assembly according to the invention.
Figure 18:
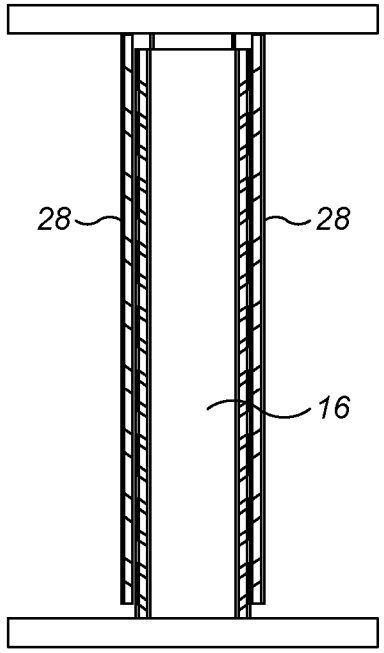
Figure 19:
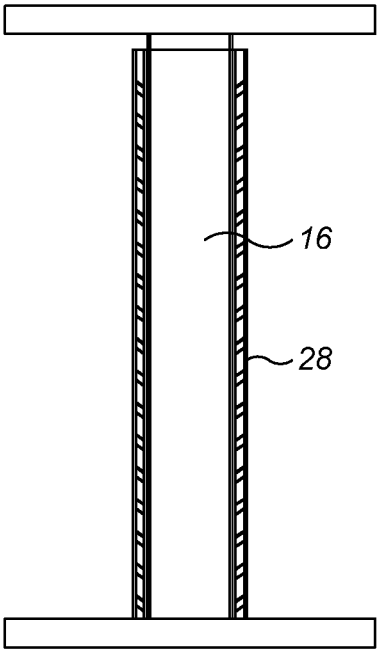
Figure 20:
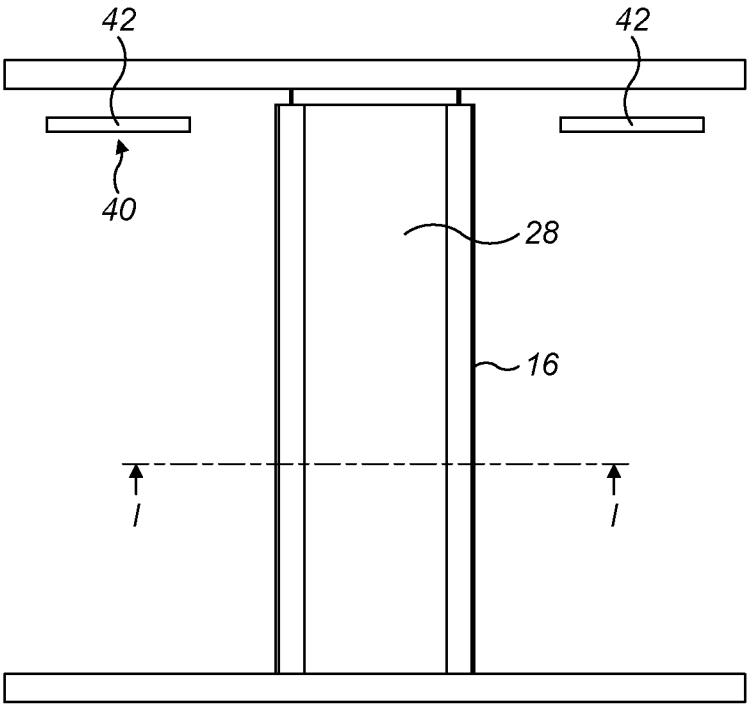
Figure 21:
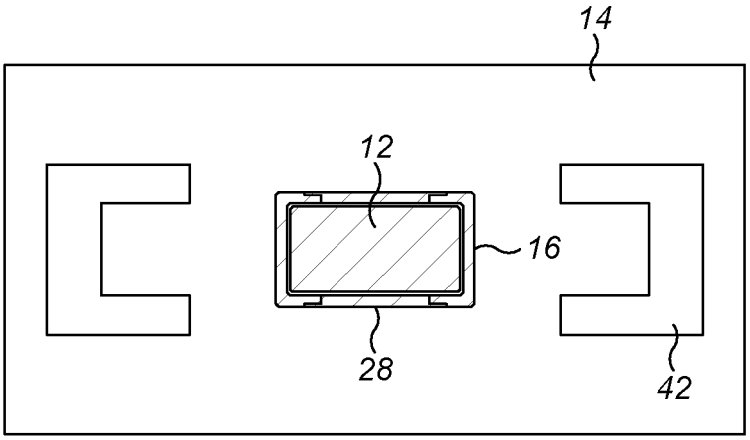
FIG. 21 is a sectional view along the line I-I of FIG. 20.
Figure 22:
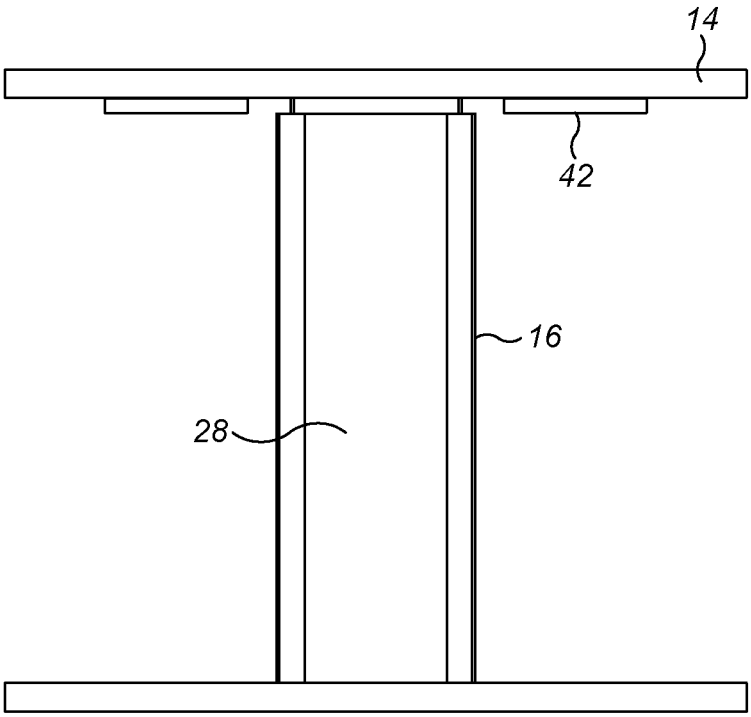
FIGS. 22 and 23 are further diagrammatic sequential side views similar to views 17 to 20.

Two second elongate members 28 are now introduced as shown in FIGS. 16 to 19 and are moved inwardly and downwardly relative to the first elongate members 16 from the position shown in FIGS. 17 and 18, to the position shown in FIG. 19, with the respective projections 22 and recesses 24 on the first elongate members 16 engaging with the projections 32 and recesses 34 on the second elongate members 28.

Figure 23:
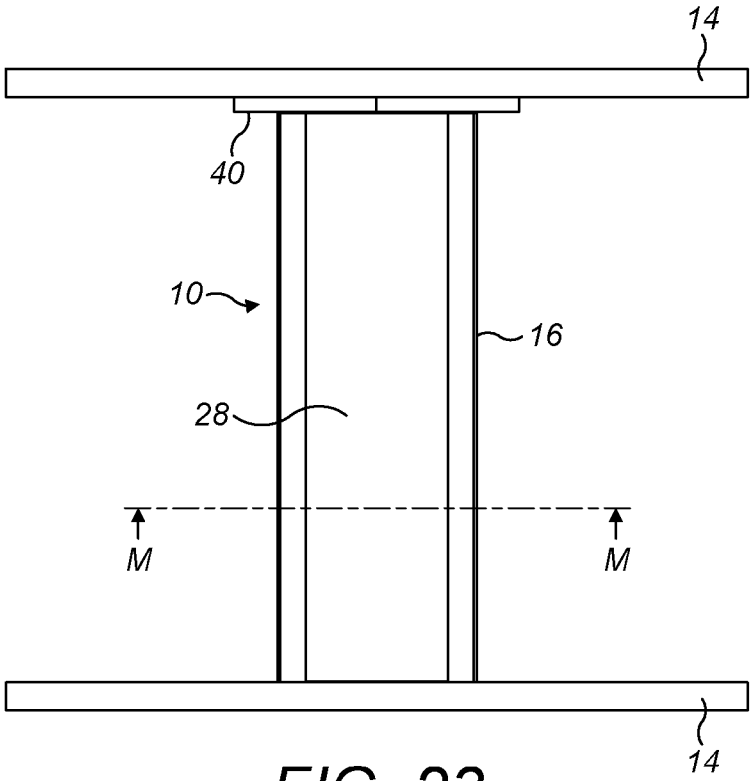
Figure 24:
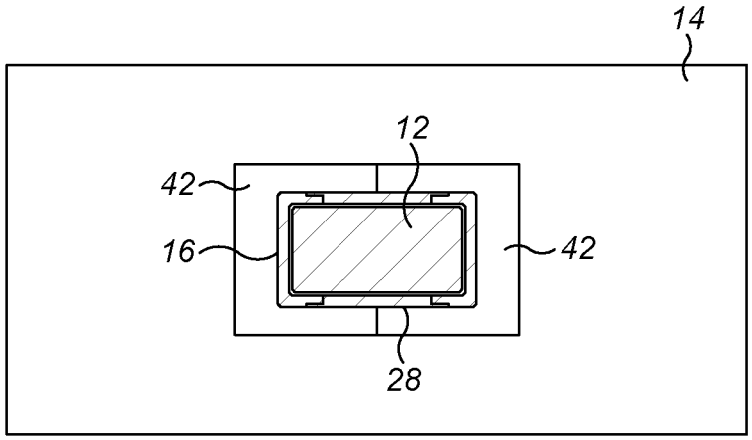
FIG. 24 is a sectional view along the line M-M of FIG. 23.

The top plate 40 can now be located in position as shown in FIGS. 20 to 24. The two U shape parts 42 of the top plate are located on the underside of the top floor 14, and slid on top of the top edges of the first and second elongate members 16, 28, to close the gap provided thereabove. This then provides a final arrangement as shown in FIGS. 23 and 24.

In use the assembly can readily be located in position in a much quicker operation than previous arrangements. The inclined dovetail projections and recesses mean that the first and second elongate members cannot be pulled apart either transversely or longitudinally. The top plate can readily be located in position and spreads the load between the top floor and the first and second elongate members. Therefore, the first and second elongate members should not move relative to each other in either of these directions, and hence not vertically nor pulled apart. The flange on the second elongate members covers the engagement members between the first and second elongate members thereby providing protection therefor and also providing an aesthetically more pleasing appearance.

Providing strengthening assemblies according to the invention increases the load capacity of existing building columns. This can allow extra levels to be added to a building. Adding additional weight to a building though exposes the floor slabs to an increased punching shear. The top plate of the strengthening assemblies though spreads the load over the floor slabs, increasing the slab capacity, and therefore prevents the columns from rupturing the slabs.

It is to be realised that various modifications may be made without departing from the scope of the invention. For instance, the first members need not necessarily be U shaped, and the engagement formations could be provided on end parts thereof. Different profile engagement formations may be provided, and at a different inclination. The top plate may take a different form. The components may be made of different materials.

A different number of elongate members may be provided, such as two or three. The elongate members may be different shapes.

Whilst endeavouring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

The invention claimed is:

1. An assembly for strengthening a building column, the assembly comprising a plurality of rigid elongate members which in use have their longitudinal directions parallel to the building column, the elongate members including inter engaging engagement formations which permit the elongate members to connect together to surround the column, wherein the engagement formations are in the form of projections and recesses, wherein the projections and recesses are inclined such that upper and lower edges of the projections are inclined downwardly inwards relative to a column in use.

2. An assembly according to claim 1, in which the engagement formations are such that once inter engaged the elongate members cannot be separated in either a directly longitudinal or a directly transverse direction.

3. An assembly according to claim 2, in which the engagement formations are in the form of respective dovetail profile projections and recesses.

4. An assembly according to claim 3, in which the inclination to the vertical of the engagement formations is between 10 and 45°.

5. An assembly according to claim 1, in which two, three or four elongate members are provided.

6. An assembly according to claim 5, in which four elongate members are provided, with two first parts and two second parts.

7. An assembly according to claim 6, in which the engagement formations are such that when two first parts are located in required positions on opposite sides of a column, two second parts can be brought together at an inclination, to respectively interconnect the four parts.

8. An assembly according to claim 7, in which the engagement formations are such that when two first parts are located in required positions on opposite sides of a column, two second parts can be brought together at a downwards inclination, to respectively interconnect the four parts.

9. An assembly according to claim 6, in which the elongate member first parts are U shaped in plan view.

10. An assembly according to claim 6, in which flanges are provided on the second parts to cover the engagement formations on the elongate members once interconnected.

11. An assembly according to claim 1, in which a collar is locatable over upper ends of the elongate members.

12. An assembly according to claim 11, in which the collar is formed of two parts, which can be slid into position on top of the upper ends of the elongate members.

13. An assembly according to claim 12, in which the two parts of the collar have a U shape in plan view.

14. An assembly according to claim 11, in which the collar is made of any of concrete, ultra high performance concrete (UHPC), or fibre reinforced (UHPFRC).

15. An assembly according to claim 1, in which the elongate members are made of any of concrete, ultra high performance concrete (UHPC), or fibre reinforced (UHPFRC).

16. A method for strengthening a building column, the method comprising locating an assembly according to claim 1 around the building column.

17. A method according to claim 16, in which the elongate members are spaced a small distance away from the building column.

18. A method according to claim 17, in which the elongate members are spaced at between 5 and 20 mm away from the building column.

19. A method according to claim 16, wherein a collar is locatable over upper ends of the elongate members, wherein the collar is formed of two parts, which can be slid into position on top of the upper ends of the elongate members, in which once the elongate members are interconnected in position around the building column, the two parts of the collar are slid on top of the elongate members from opposite sides until they meet.

20. A method according to claim 16, wherein a collar is locatable over upper ends of the elongate members, wherein the collar is formed of two parts, which can be slid into position on top of the upper ends of the elongate members, in which the two parts of the collar have a U shape is plan view, in which elongate member first parts are located in a required position relative to the building column and elongate member second parts then interconnected to the first parts.

* * * * *